US009457602B2

(12) United States Patent
Terada

(10) Patent No.: US 9,457,602 B2
(45) **Date of Patent: *Oct. 4, 2016**

(54) INKJET PRINTER AND METHOD FOR ACQUIRING GAP INFORMATION

(71) Applicant: BROTHER KOGYO KABUSHIKI KAISHA, Nagoya, Aichi (JP)

(72) Inventor: Kohei Terada, Kiyosu (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/886,527

(22) Filed: Oct. 19, 2015

(65) Prior Publication Data

US 2016/0039233 A1 Feb. 11, 2016

Related U.S. Application Data

(63) Continuation of application No. 14/587,267, filed on Dec. 31, 2014, now Pat. No. 9,162,502, which is a continuation of application No. 14/246,238, filed on Apr. 7, 2014, now Pat. No. 8,926,055, which is a continuation of application No. 13/729,753, filed on Dec. 28, 2012, now Pat. No. 8,727,479.

(30) Foreign Application Priority Data

Mar. 30, 2012 (JP) ..... 2012-082621

(51) Int. Cl.
*B41J 29/393* (2006.01)
*B41J 25/308* (2006.01)
(Continued)

(52) U.S. Cl.
CPC ..... *B41J 25/308* (2013.01); *B41J 2/01* (2013.01); *B41J 11/001* (2013.01); *B41J 11/005* (2013.01); *B41J 25/001* (2013.01)

(58) Field of Classification Search
CPC .... B41J 29/393; B41J 1/0095; B41J 2/2142; B41J 25/308
See application file for complete search history.

(56) References Cited

U.S. PATENT DOCUMENTS 5,659,404 A 8/1997 Matsuda
6,092,939 A 7/2000 Nishikori et al.
(Continued)

FOREIGN PATENT DOCUMENTS

CN 1990242 A 7/2007
CN 101058244 A 10/2007
(Continued)

OTHER PUBLICATIONS

Extended European Search Report dated Jul. 9, 2013 from related EP 12199740.7 from parent application U.S. Appl. No. 13/729,753.
(Continued)

*Primary Examiner* — Lamson Nguyen
(74) *Attorney, Agent, or Firm* — Scully, Scott, Murphy & Presser, P.C.

(57) ABSTRACT

An inkjet printer is provided that is configured to store a plurality of pieces of gap information respectively corresponding to a plurality of examined sections discretely arranged along a head moving direction on a recording sheet, each of the plurality of examined sections including a corresponding one portion of top portions and bottom portions on the recording sheet, and calculate interpolation gap information to be interpolated over a whole width in the head moving direction of at least one of a plurality of segments, each of which has a width in the head moving direction defined by two adjacent sections of the plurality of examined sections, based on the stored gap information.

10 Claims, 10 Drawing Sheets

(51) Int. Cl.

| | |
|---|---|
| ***B41J 11/00*** | (2006.01) |
| ***B41J 25/00*** | (2006.01) |
| ***B41J 2/01*** | (2006.01) |

(56) References Cited

U.S. PATENT DOCUMENTS

| | | | | |
|---|---|---|---|---|
| 6,310,637 | B1 | 10/2001 | Shimada et al. | |
| 6,604,803 | B1 | 8/2003 | Hanabusa et al. | |
| 7,083,245 | B2 | 8/2006 | Yamamoto | |
| 7,309,179 | B2 | 12/2007 | Toran et al. | |
| 7,530,659 | B2 | 5/2009 | Doherty et al. | |
| 8,118,422 | B2 | 2/2012 | Hibbard et al. | |
| 8,282,194 | B2 | 10/2012 | Ozawa | |
| 8,556,382 | B2 | 10/2013 | Kang | |
| 9,162,502 | B2 * | 10/2015 | Terada | B41J 25/001 |
| 2002/0196298 | A1 | 12/2002 | Cheng et al. | |
| 2004/0126164 | A1 | 7/2004 | Ohyama | |
| 2005/0168557 | A1 | 8/2005 | Ohyama | |
| 2007/0229562 | A1 | 10/2007 | Doherty et al. | |
| 2008/0150978 | A1 | 6/2008 | Sato et al. | |
| 2009/0262157 | A1 | 10/2009 | Sato et al. | |
| 2011/0249049 | A1 | 10/2011 | Taira et al. | |

FOREIGN PATENT DOCUMENTS

| | | | |
|---|---|---|---|
| EP | 0622227 | A2 | 4/1994 |
| JP | H08-307688 | A | 11/1996 |
| JP | H10-138463 | A | 5/1998 |
| JP | 11-138923 | A | 5/1999 |
| JP | H11-151242 | A | 6/1999 |
| JP | 2000-71532 | A | 3/2000 |
| JP | 2002-160357 | A | 6/2002 |
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2006-192636 | A | 7/2006 |
| JP | 2006-192814 | A | 7/2006 |
| JP | 2007-25492 | A | 2/2007 |
| JP | 2007-144718 | A | 6/2007 |
| JP | 2008-155423 | A | 7/2008 |
| JP | 2008-155424 | A | 7/2008 |
| JP | 2008-230069 | A | 10/2008 |
| JP | 2009-23121 | A | 2/2009 |
| JP | 2009-143152 | A | 7/2009 |
| JP | 2009-178986 | A | 8/2009 |
| JP | 2009-202430 | A | 9/2009 |
| JP | 2009-255386 | A | 11/2009 |
| JP | 2011-218625 | A | 11/2011 |

OTHER PUBLICATIONS

Notice of Allowance dated Jan. 8, 2014 from related U.S. Appl. No. 13/729,753.

Notification of First Office Action dated Sep. 4, 2014 received from the Chinese Patent Office from related Chinese Patent Application No. 201210586540.3, together with an English language translation.

Notice of Allowance dated Sep. 2, 2014 from related U.S. Appl. No. 14/246,238.

Notice of Reasons for Rejection dated Jul. 15, 2014 from related Japanese Application No. 2012-082621, together with an English language translation.

Japanese Official Action dated Feb. 17, 2015 received in related application JP 2012-082621 together with an English language translation.

Notice of Allowance dated Feb. 20, 2015 from related U.S. Appl. No. 14/587,267.

Notice of Allowance dated Jun. 12, 2015 from related U.S. Appl. No. 14/587,267.

Notice of Allowance dated Jul. 23, 2015 from related U.S. Appl. No. 14/587,267.

Japanese Official Action dated Feb. 2, 2016 received in related application JP 2012-286356 together with an English language translation.

Japanese Official Action dated Feb. 2, 2016 received in related application JP 2012-286357 together with an English language translation.

Japanese Official Action dated Feb. 2, 2016 received in related application JP 2012-286358 together with an English language translation.

Japanese Notification of Reasons for Rejection dated Jul. 26, 2016 received in related application JP 2015-173555 together with an English language translation.

* cited by examiner

INKJET PRINTER AND METHOD FOR ACQUIRING GAP INFORMATION

CROSS-REFERENCE TO RELATED APPLICATION

This application is a continuation of U.S. Ser. No. 14/587,267 filed on Dec. 31, 2014, which is a continuation application of U.S. Ser. No. 14/246,238 filed on Apr. 7, 2014, now U.S. Pat. No. 8,926,055 granted on Jan. 6, 2015, which is a continuation application of U.S. Ser. No. 13/729,753 filed on Dec. 28, 2012, now U.S. Pat. No. 8,727,479 granted on May 20, 2014 and claims priority under 35 U.S.C. §119 from Japanese Patent Application No. 2012-082621 filed on Mar. 30, 2012. The entire subject matter of each of which are incorporated herein by reference.

BACKGROUND

1. Technical Field

The following description relates to one or more techniques for acquiring gap information related to a gap between an ink discharging surface of an inkjet head and a recording medium in an inkjet printer.

2. Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined head moving direction. Further, the known inkjet printer is configured to cause feed rollers or corrugated holding spur wheels to press the recording sheet against a surface of a platen that has thereon convex portions and concave portions alternately formed along the head moving direction, so as to deform the recording sheet in a predetermined wave shape. The predetermined wave shape has mountain portions protruding toward an ink discharging surface of the recording head, and valley portions recessed in a direction opposite to the direction toward the ink discharging surface, the mountain portions and the valley portions alternately arranged along the head moving direction.

SUMMARY

In the known inkjet printer, the gap between the ink discharging surface of the recording head and the recording sheet varies depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, it might result in a low-quality printed image. Further, in this case, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on a gap between the ink discharging surface of the inkjet head and each individual portion of the mountain portions and the valley portions on the recording sheet. Further, in order to adjust the ink discharging timing, it is required to acquire gap information related to the gap between the ink discharging surface of the inkjet head and each individual portion of the mountain portions and the valley portions on the recording sheet.

Aspects of the present invention are advantageous to provide one or more improved techniques for an inkjet printer that make it possible to acquire gap information related to a gap between an ink discharging surface of an inkjet head and each individual portion of mountain portions and valley portions on a recording sheet deformed in a wave shape.

According to aspects of the present invention, an inkjet printer is provided, which includes an inkjet head configured to discharge ink droplets from nozzles formed in an ink discharging surface thereof, a head moving unit configured to reciprocate the inkjet head relative to a recording sheet along a head moving direction parallel to the ink discharging surface, a wave shape generating mechanism configured to deform the recording sheet in a predetermined wave shape that has top portions of portions protruding in a first direction toward the ink discharging surface and bottom portions of portions recessed in a second direction opposite to the first direction, the top portions and the bottom portions alternately arranged along the head moving direction, a storing device configured to store gap information related to a gap between the ink discharging surface and the recording sheet, the gap information including a plurality of pieces of gap information respectively corresponding to a plurality of examined sections discretely arranged along the head moving direction on the recording sheet, each of the plurality of examined sections including a corresponding one portion of the top portions and the bottom portions on the recording sheet, and a calculating unit configured to calculate interpolation gap information to be interpolated over a whole width in the head moving direction of at least one of a plurality of segments, each of which has a width in the head moving direction defined by two adjacent sections of the plurality of examined sections, based on the gap information stored in the storing device.

According to aspects of the present invention, further provided is an inkjet printer that includes an inkjet head configured to discharge ink droplets from nozzles formed in an ink discharging surface thereof, a head moving unit configured to reciprocate the inkjet head relative to a recording sheet along a head moving direction parallel to the ink discharging surface, a wave shape generating mechanism configured to deform the recording sheet in a predetermined wave shape that has top portions of portions protruding in a first direction toward the ink discharging surface and bottom portions of portions recessed in a second direction opposite to the first direction, the top portions and the bottom portions alternately arranged along the head moving direction, and a control device configured to acquire gap information related to a gap between the ink discharging surface and the recording sheet, the gap information including a plurality of pieces of gap information respectively corresponding to a plurality of examined sections discretely arranged along the head moving direction on the recording sheet, each of the plurality of examined sections including a corresponding one portion of the top portions and the bottom portions on the recording sheet, store the acquired gap information, and calculate interpolation gap information to be interpolated over a whole width in the head moving direction of at least one of a plurality of segments, each of which has a width in the head moving direction defined by two adjacent sections of the plurality of examined sections, based on the stored gap information.

According to aspects of the present invention, further provided is a method configured to be implemented on a control device connected with an inkjet printer, the inkjet printer including an inkjet head configured to discharge ink droplets from nozzles formed in an ink discharging surface thereof, a head moving unit configured to reciprocate the inkjet head relative to a recording sheet along a head moving direction parallel to the ink discharging surface, and a wave shape generating mechanism configured to deform the recording sheet in a predetermined wave shape that has top portions of portions protruding in a first direction toward the ink discharging surface and bottom portions of portions recessed in a second direction opposite to the first direction, the top portions and the bottom portions alternately arranged along the head moving direction, the method including steps of storing gap information related to a gap between the ink discharging surface and the recording sheet, the gap information including a plurality of pieces of gap information respectively corresponding to a plurality of examined sections discretely arranged along the head moving direction on the recording sheet, each of the plurality of examined sections including a corresponding one portion of the top portions and the bottom portions on the recording sheet; and calculating interpolation gap information to be interpolated over a whole width in the head moving direction of at least one of a plurality of segments, each of which has a width in the head moving direction defined by two adjacent sections of the plurality of examined sections, based on the stored gap information.

BRIEF DESCRIPTION OF THE ACCOMPANYING DRAWINGS

Figure 1:
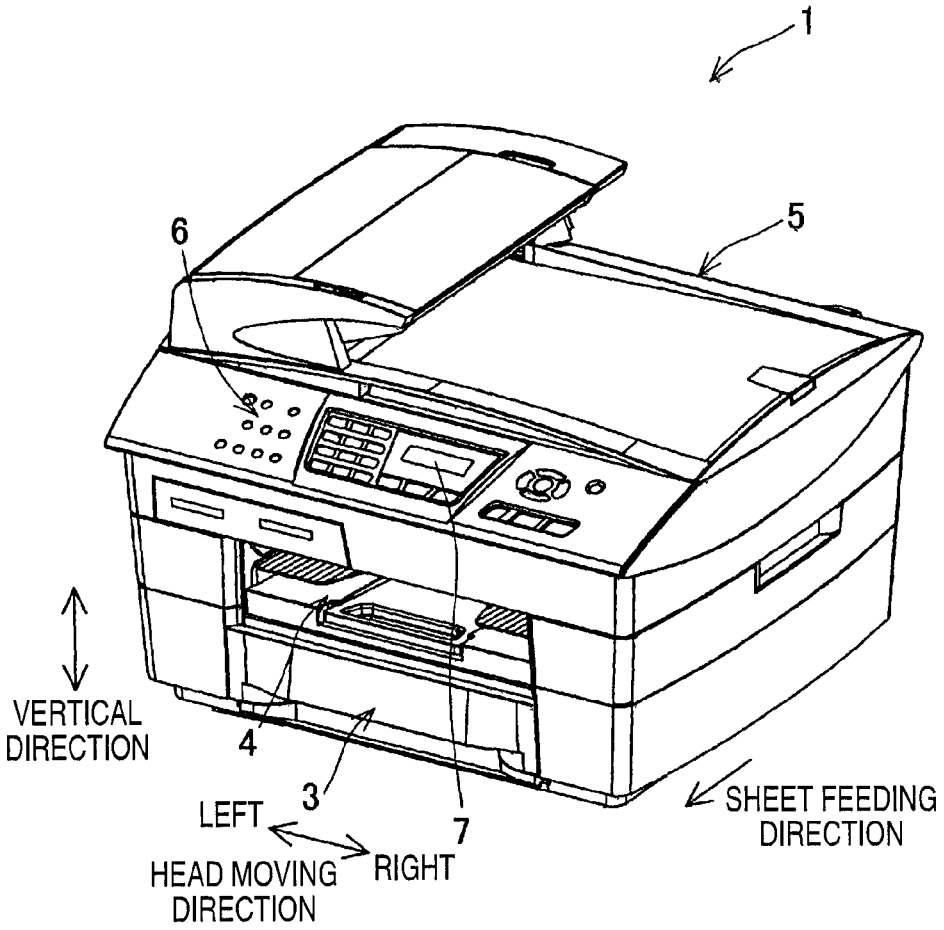
FIG. 1 is a perspective view schematically showing a configuration of an inkjet printer in an embodiment according to one or more aspects of the present invention.
Figure 2:
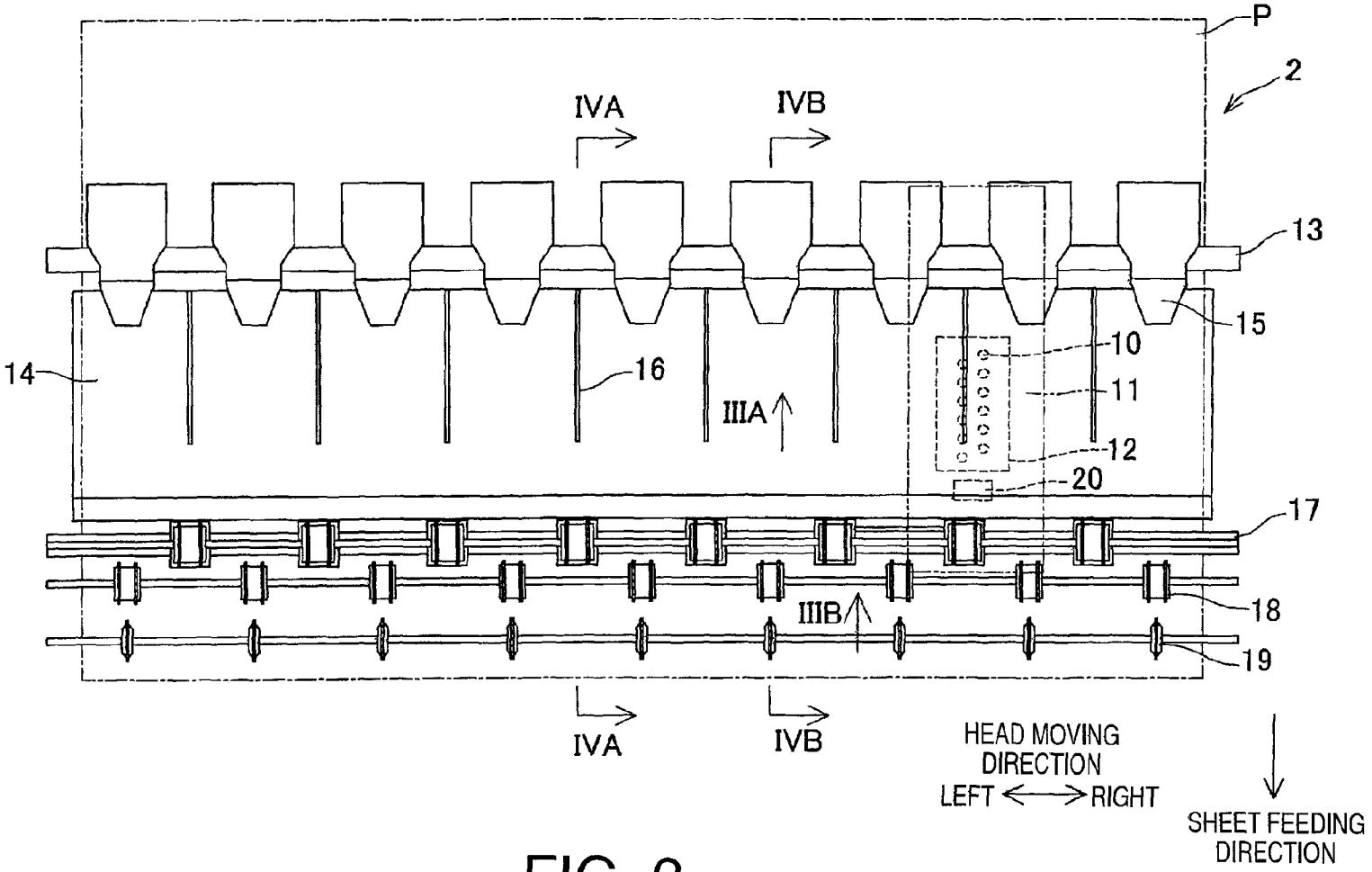
FIG. 2 is a top view of a printing unit of the inkjet printer in the embodiment according to one or more aspects of the present invention.
Figure 3A:
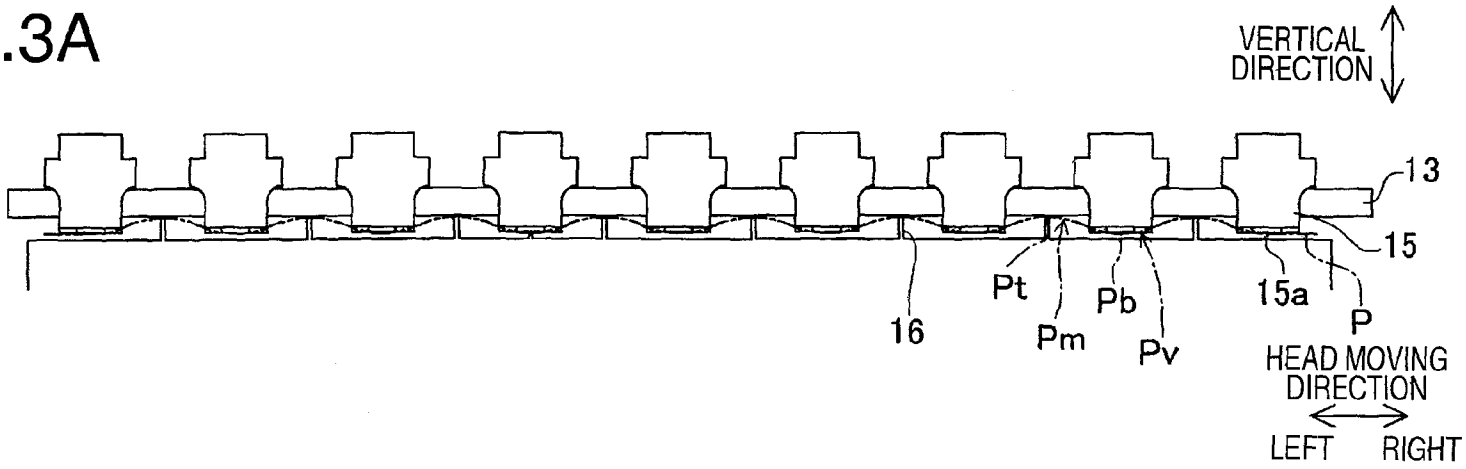

FIG. 3A schematically shows a part of the printing unit when viewed along an arrow IIIA shown in FIG. 2 in the embodiment according to one or more aspects of the present invention.

Figure 3B:
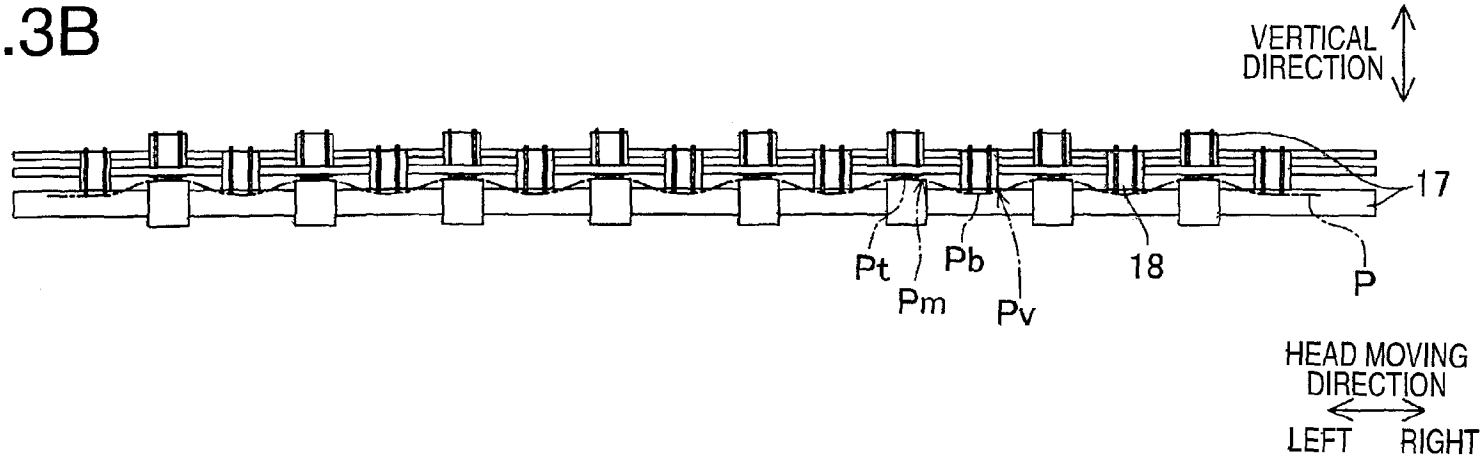

FIG. 3B schematically shows a part of the printing unit when viewed along an arrow IIIB shown in FIG. 2 in the embodiment according to one or more aspects of the present invention.

Figure 4A:
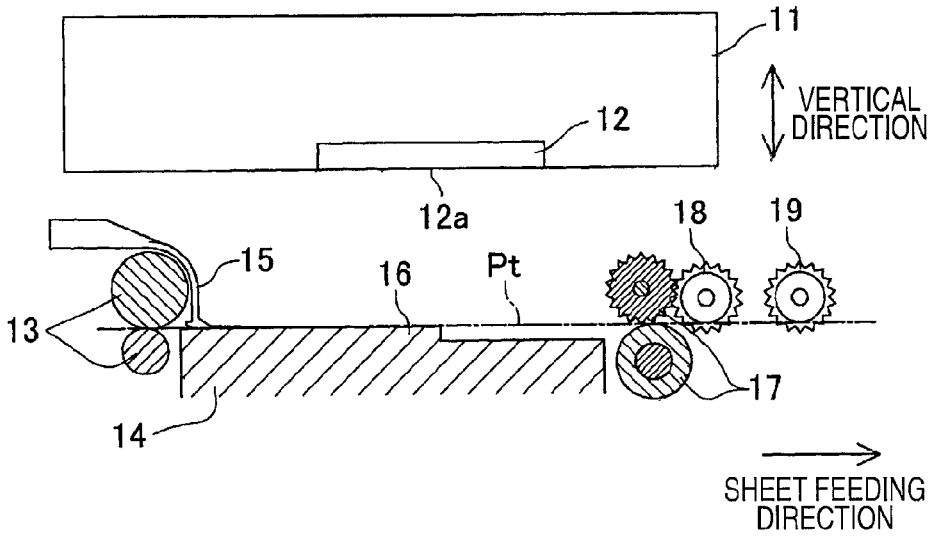

FIG. 4A is a cross-sectional view taken along a line IVA-IVA shown in FIG. 2 in the embodiment according to one or more aspects of the present invention.

Figure 4B:
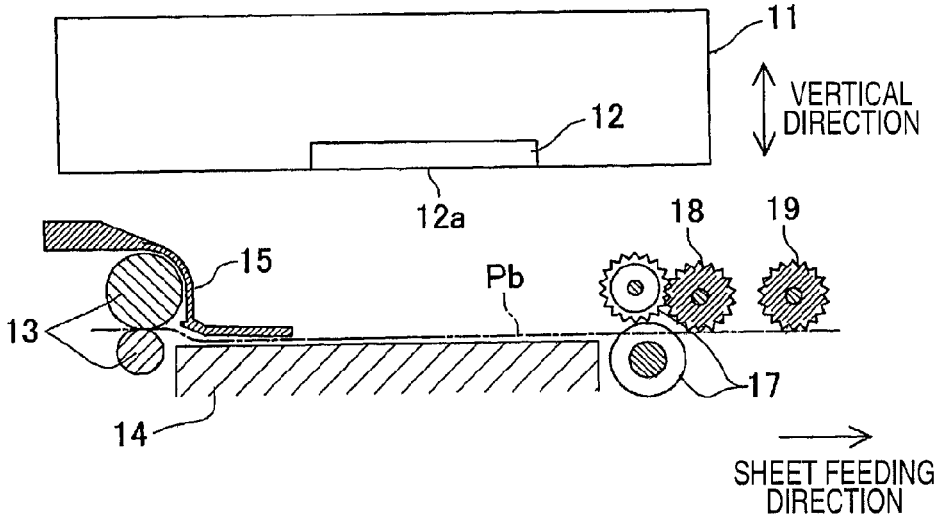

FIG. 4B is a cross-sectional view taken along a line IVB-IVB shown in FIG. 2 in the embodiment according to one or more aspects of the present invention.

Figure 5:
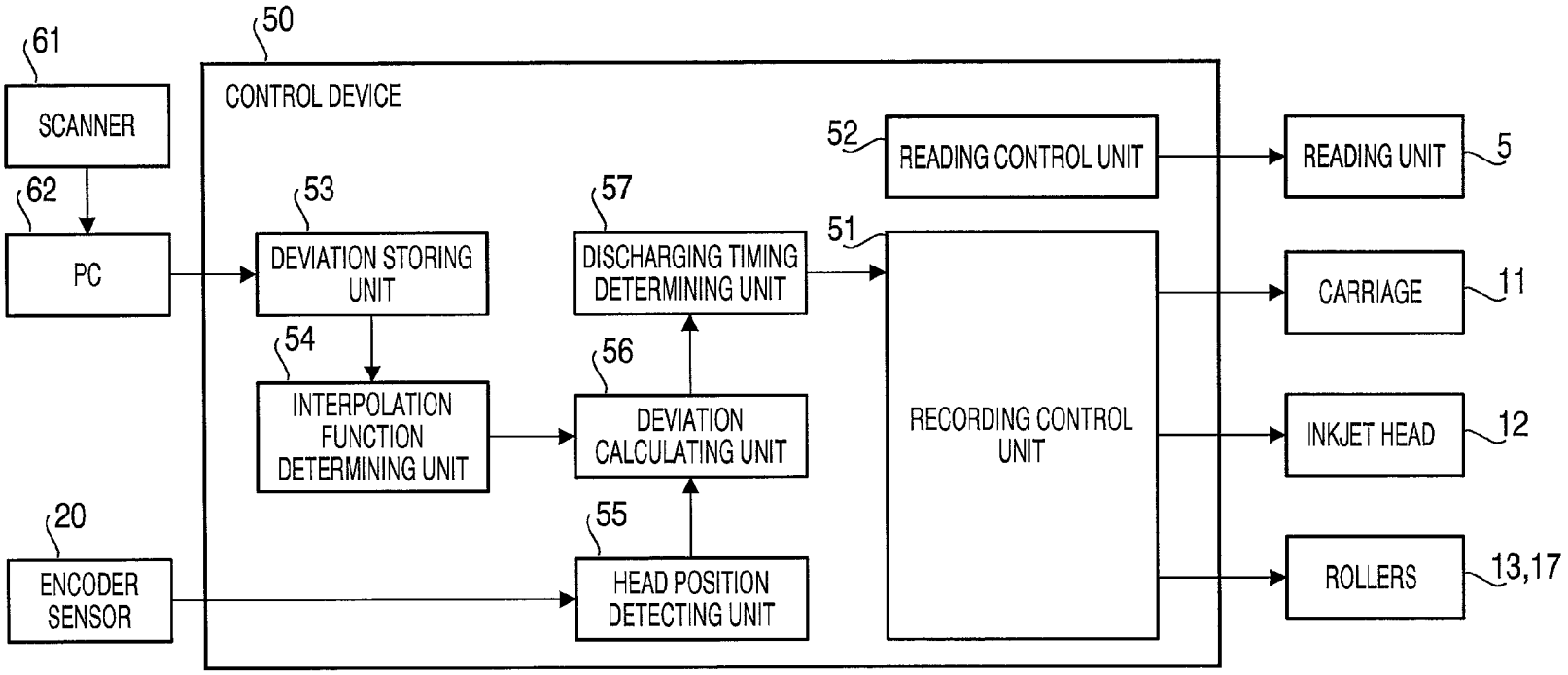

FIG. 5 is a functional block diagram of a control device of the inkjet printer in the embodiment according to one or more aspects of the present invention.

Figure 6:
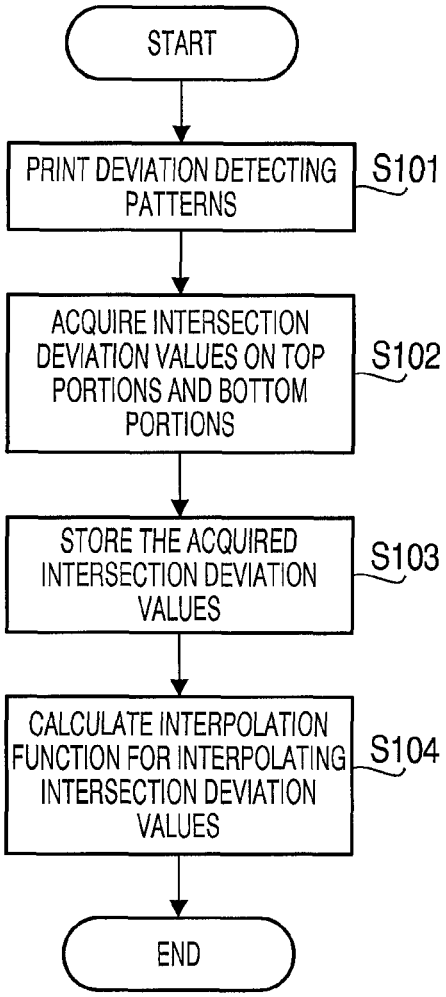

FIG. 6 is a flowchart showing a process to be executed in advance of a printing operation, in a procedure to determine ink discharging timing to discharge ink from nozzles in the inkjet printer, in the embodiment according to one or more aspects of the present invention.

Figure 7A:
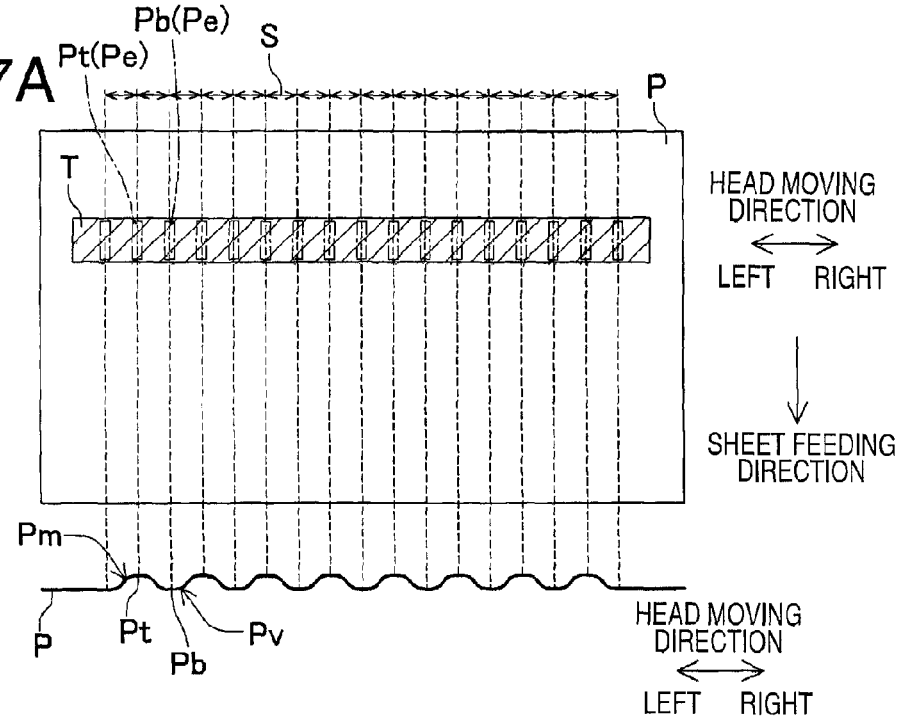

FIG. 7A shows sections to be read of a patch that includes a plurality of deviation detecting patterns printed on a recording sheet in the embodiment according to one or more aspects of the present invention.

Figure 7B:
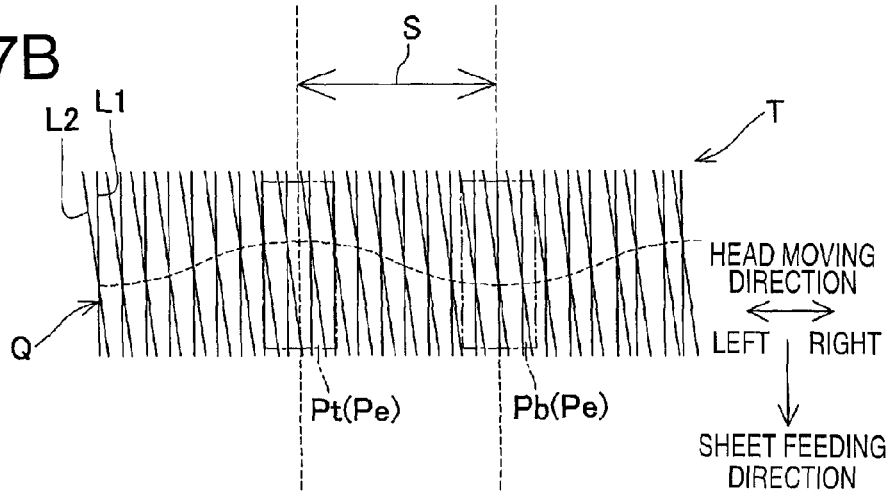

FIG. 7B is an enlarged view partially showing the patch that includes the plurality of deviation detecting patterns printed on the recording sheet in the embodiment according to one or more aspects of the present invention.

Figure 8A:
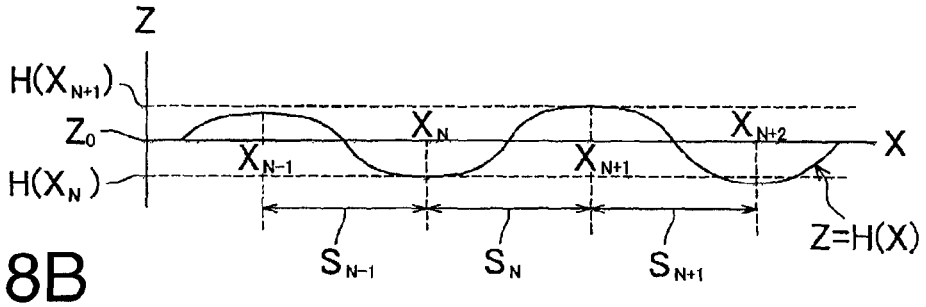

FIG. 8A shows a relationship between a position in a head moving direction on the recording sheet and the height of the recording sheet in the embodiment according to one or more aspects of the present invention.

Figure 8B:
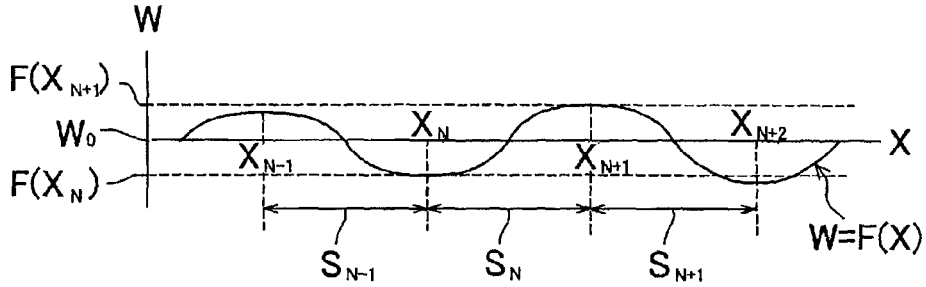

FIG. 8B shows a relationship between the position in the head moving direction on the recording sheet and a positional deviation value in the head moving direction of an ink droplet landing in the position on the recording sheet in the embodiment according to one or more aspects of the present invention.

Figure 8C:
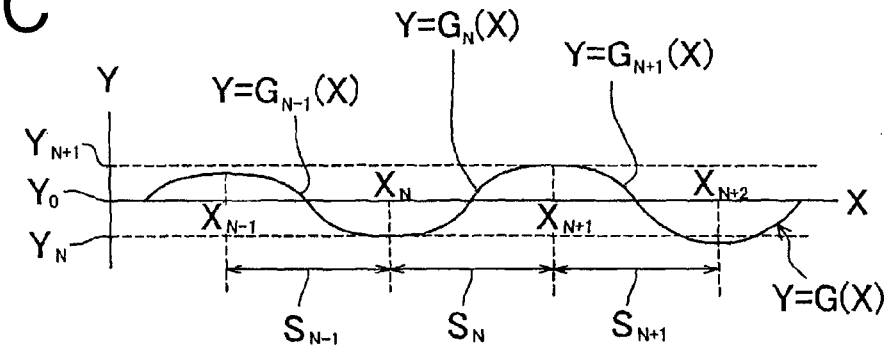

FIG. 8C shows a relationship between the position in the head moving direction on the recording sheet and an intersection deviation value in a sheet feeding direction of a pattern intersection formed on the recording sheet in the embodiment according to one or more aspects of the present invention.

Figure 8D:
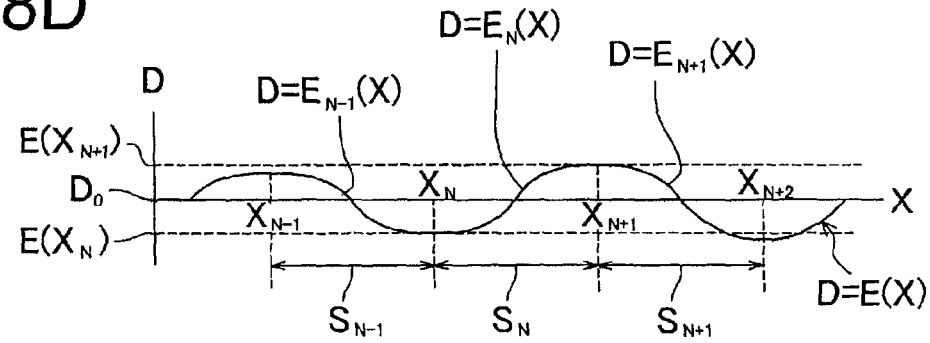

FIG. 8D shows a relationship between the position in the head moving direction on the recording sheet and a delay time for adjusting the ink discharging timing in the embodiment according to one or more aspects of the present invention.

Figure 9:
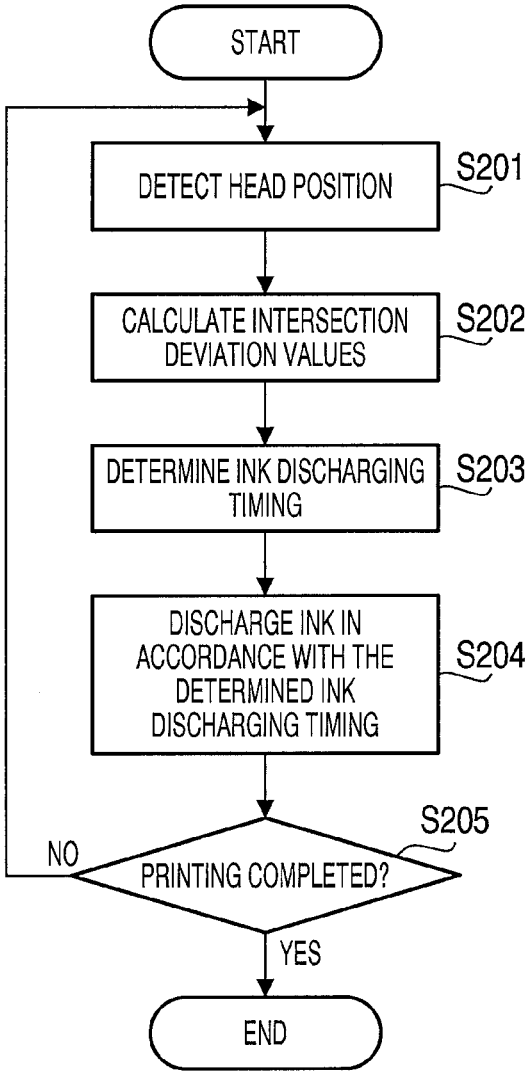

FIG. 9 is a flowchart showing a process to be executed in the printing operation, in the procedure to determine the ink discharging timing to discharge ink from the nozzles in the inkjet printer, in the embodiment according to one or more aspects of the present invention.

Figure 10:
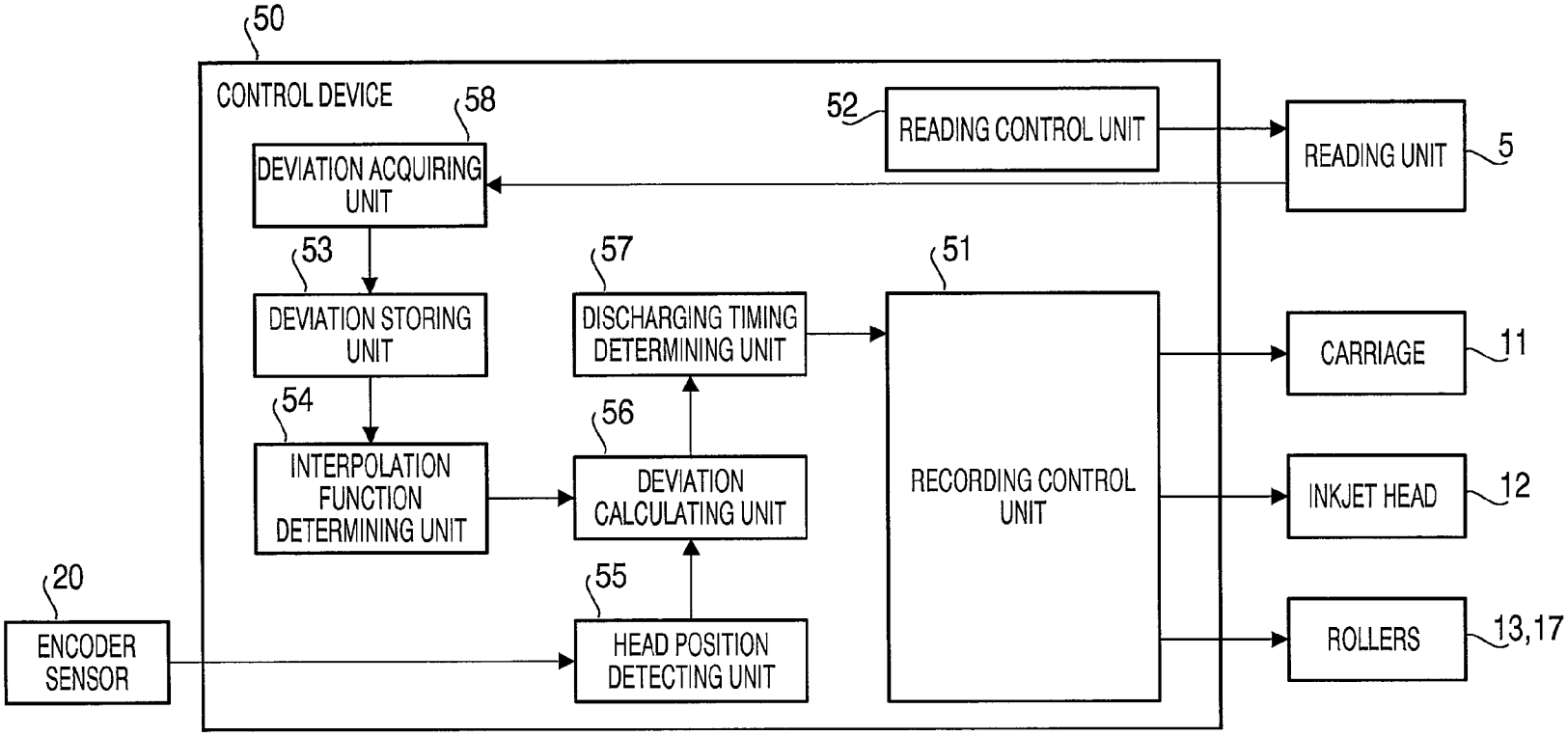

FIG. 10 is a functional block diagram of a control device of an inkjet printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured to be, for instance, an image scanner for reading images. The operation unit 6 is provided with buttons. A user is allowed to operate the inkjet printer 1 via the buttons of the operation unit 6. The display unit 7 is configured, for instance, as a liquid crystal display, to display information when the inkjet printer 1 is used.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, and a plurality of corrugated spur wheels 18 and 19. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a guiderail (not shown) in a head moving direction. The inkjet head 12 is mounted on the carriage 11. The inkjet head 12 is configured to discharge ink from a plurality of nozzles 10 formed in an ink discharging surface 12*a* that is a lower surface of the inkjet head 12.

The feed rollers 13 are two rollers configured to pinch therebetween the recording sheet P fed by the sheet feeding unit 3 and feed the recording sheet P in a sheet feeding direction perpendicular to the head moving direction. The platen 14 is disposed to face the ink discharging surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the head moving direction. The recording sheet P, fed by the feed rollers 13, passes between the platen 14 and the corrugated plates 15. At this time, pressing surfaces 15*a*, which are lower surfaces of the plurality of corrugated plates 15, press the recording sheet P from above.

Each individual rib 16 is disposed between corresponding two mutually-adjacent corrugated plates 15 in the head moving direction, on the upper surface of the platen 14. The plurality of ribs 16 are arranged at substantially regular intervals along the head moving direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the head moving direction and feed the recording sheet P toward the sheet ejecting unit 4. An upper one of the ejection rollers 17 is provided with spur wheels so as to prevent the ink attached onto the recording sheet P from transferring to the upper ejection roller 17.

The plurality of corrugated spur wheels 18 are disposed substantially in the same positions as the corrugated plates 15 in the head moving direction, at a downstream side relative to the ejection rollers 17 in the sheet feeding direction. The plurality of corrugated spur wheels 19 are disposed substantially in the same positions as the corrugated plates 15 in the head moving direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIG. 3, the recording sheet P on the platen 14 is bent and deformed in such a wave shape that mountain portions Pm protruding upward (i.e., toward the ink discharging surface 12*a*) and valley portions Pv recessed downward (i.e., in a direction opposite to the direction toward the ink discharging surface 12*a*) are alternately arranged. Further, each mountain portion Pm has a top portion (peak portion) Pt, protruding up to the highest position of the mountain portion Pm, which is located substantially in the same position as the center of the corresponding rib 16 in the head moving direction. Each valley portion Pv has a bottom portion Pb, recessed down to the lowest position of the valley portion Pv, which is located substantially in the same position as the corresponding corrugated plate 15 and the corresponding corrugated spur wheels 18 and 19.

An encoder sensor 20 is mounted on the carriage 11. The encoder sensor 20 and an encoder belt (not shown) extending along the head moving direction form a linear encoder. The encoder sensor 20 is configured to detect slits formed in the encoder belt and thereby detect the position of the inkjet head 12 moving together with the carriage 11 along the head moving direction.

The printing unit 2 configured as above performs printing on the recording sheet P, by discharging ink from the inkjet head 12 reciprocating together with the carriage 11 along the head moving direction while feeding the recording sheet P in the sheet feeding direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, a deviation storing unit 53, an interpolation function determining unit 54, a head position detecting unit 55, a deviation calculating unit 56, and a discharging timing determining unit 57 (see FIG. 5).

The recording control unit 51 is configured to control operations of the carriage 11, the inkjet head 12, the feed rollers 13, and the ejection rollers 17 when the inkjet printer 1 performs a printing operation. The reading control unit 52 is configured to control operations of the reading unit 5 in image reading.

As will be described later, the deviation storing unit 53 is configured to store (retain) a deviation value (hereinafter, which may be referred to as an intersection deviation value) in the sheet feeding direction of an intersection between two lines of a deviation detecting pattern formed on each individual portion of the plurality of top portions Pt and the plurality of bottom portions Pb. The interpolation function determining unit 54 is configured to determine an interpolation function for interpolating intersection deviation values over a whole wave-shaped area of the recording sheet P in the head moving direction, from the intersection deviation values stored in the deviation storing unit 53.

The head position detecting unit 55 is configured to detect the position of the inkjet head 12 reciprocating together with the carriage along the head moving direction in a printing operation, from the detection result of the encoder sensor 20. As will be described later, the deviation calculating unit 56 is configured to calculate the intersection deviation value on each portion of the recording sheet P from factors such as the position of the inkjet head 12 detected by the head position detecting unit 55 and the interpolation function determined by the interpolation function determining unit 54.

The discharging timing determining unit 57 is configured to determine ink discharging timing (moments) to discharge ink from the nozzles 10, based on the intersection deviation values calculated by the deviation calculating unit 56.

Subsequently, an explanation will be provided about a procedure to determine the ink discharging timing to discharge ink from the nozzles 10 and perform a printing operation in the inkjet printer 1. In order to determine the ink discharging timing and perform the printing operation, below-mentioned steps S101 to S103 shown in FIG. 6 are previously executed before the user performs the printing operation using the inkjet printer 1, e.g., at a stage of manufacturing the inkjet printer 1. Then, below-mentioned steps S201 to S205 shown in FIG. 9 are executed when the user performs the printing operation using the inkjet printer 1.

In S101, the control device 50 controls the printing unit 2 to print on the recording sheet P a patch T, which includes a plurality of deviation detecting patterns Q as shown in FIGS. 7A and 7B. More specifically, for instance, the control device 50 controls the printing unit 2 to print a plurality of straight lines L1, which extend in parallel with the sheet feeding direction and are arranged along the head moving direction, by discharging ink from the nozzles 10 while moving the carriage 11 toward one side along the head moving direction. After that, the control device 50 controls the printing unit 2 to print a plurality of straight lines L2, which are tilted with respect to the sheet feeding direction and intersect the plurality of straight lines L1, respectively, by discharging ink from the nozzles 10 while moving the carriage 11 toward the other side along the head moving direction. Thereby, as shown in FIGS. 7A and 7B, the patch T is printed that includes the plurality of deviation detecting patterns Q arranged along the head moving direction, each deviation detecting pattern Q including a combination of the mutually intersecting straight lines L1 and L2. It is noted that, at this time, ink droplets are discharged from the nozzles 10 in accordance with design-based ink discharging timing that is determined, for example, based on an assumption that the recording sheet P is not in the wave shape but flat.

In S102, an image scanner 61, which is provided separately from the inkjet printer 1, is caused to read the plurality of deviation detecting patterns Q printed in S101. Further, in S102, a PC 62, which is connected with the image scanner 61, is caused to acquire the intersection deviation value on each individual portion of the plurality of top portions Pt and the plurality of bottom portions Pb, from the read deviation detecting patterns Q.

More specifically, for example, when the deviation detecting patterns Q as shown in FIGS. 7A and 7B are printed in a situation where there is a deviation between the ink landing position in the rightward movement of the carriage 11 along the head moving direction and the ink landing position in the leftward movement of the carriage 11 along the head moving direction, the straight line L1 and the straight line L2 of a deviation detecting pattern Q are printed to be deviated from each other in the head moving direction. Therefore, the straight line L1 and the straight line L2 form an intersection thereof (hereinafter referred to as a pattern intersection) in a position deviated from the center of the straight lines L1 and L2 in the sheet feeding direction depending on the positional deviation value in the head moving direction between the ink landing positions. Further, when the reading unit 5 reads each deviation detecting pattern Q, the reading unit 5 detects a higher brightness at the pattern intersection than the brightness at any other portion of the read deviation detecting pattern Q. This is because the ratio of the areas (black) of the straight lines L1 and L2 relative to the background areas (white) of the recording sheet P is smaller at the pattern intersection than at any other portion. Accordingly, by reading each deviation detecting pattern Q and acquiring a position where the highest brightness is detected within the read deviation detecting pattern Q, it is possible to detect the position of the intersection of the straight lines L1 and L2 in the sheet feeding direction.

A positional deviation in the sheet feeding direction of the intersection of the straight lines L1 and L2 is proportional to a positional deviation in the head moving direction of the intersection of the straight lines L1 and L2. Specifically, when a relative slope between the straight lines L1 and L2 is described by a ratio of "the component in the sheet feeding direction:the component in the head moving direction" equal to "10:1," the positional deviation in the sheet feeding direction of the intersection of the straight lines L1 and L2 is ten times as large as the positional deviation in the head moving direction of the intersection of the straight lines L1 and L2. In general, when an angle between the straight lines L1 and L2 is $\theta$, the positional deviation in the sheet feeding direction of the intersection of the straight lines L1 and L2 is $1/\tan\theta$ times as large as the positional deviation in the head moving direction of the intersection of the straight lines L1 and L2. Thus, by detecting an intersection deviation value of a pattern intersection in the sheet feeding direction, it is possible to acquire information on a positional deviation value with respect to the ink landing position in the main scanning direction (i.e., the head moving direction) in bidirectional printing.

In the embodiment, the intersection deviation value of each individual portion of the top portions Pt and the bottom portions Pb is acquired by reading deviation detecting patterns Q printed on the corresponding portion of the top portions Pt and the bottom portions Pb of the recording sheet P (see sections surrounded by alternate long and short dash lines in FIG. 7A, which may hereinafter be referred to as examined sections Pe).

As described above, in S102, the image scanner 61 is caused to read only the deviation detecting patterns Q printed on the top portions Pt and the bottom portions Pb of the recording sheet P. Therefore, in S101, the control device 50 may control the printing unit 2 to print the deviation detecting patterns Q at least on the top portions Pt and the bottom portions Pb of the recording sheet P.

In S103, as indicated by a dashed line in FIG. 5, the deviation storing unit 53 is communicably connected with the PC 62, and is caused to store the intersection deviation value, acquired in S102, on each individual portion of the top portions Pt and the bottom portions Pb. It is noted that the connection between the deviation storing unit 53 and the PC 62 may be established at any time before S103.

The positional deviation value with respect to the ink landing position varies depending on positions on the wave-shaped recording sheet P in the head moving direction. Further, the positional deviation value with respect to the ink landing position varies depending on other factors such as the height at which the recording sheet P as a whole is set, the moving speed of the carriage 11, and the velocity of a flying ink droplet, regardless of whether the recording sheet P is deformed in the wave shape.

Namely, the intersection deviation value acquired in S102 contains a component caused due to the wave shape of the recording sheet P and a component caused the other factors such as the height at which the recording sheet P as a whole is set, the moving speed of the carriage 11, and the velocity of a flying ink droplet, regardless of whether the recording sheet P is deformed in the wave shape. Accordingly, each individual intersection deviation value is represented using the average value of the intersection deviation values acquired from the plurality of examined sections Pe and the deviation of the individual intersection value relative to the average value. Hence, in S103, each individual intersection deviation value is stored in the deviation storing unit 53 in a form divided into the average value and the deviation from the average value.

In S104, the control device 50 (the interpolation function determining unit 54) determines an interpolation function G(X) for calculating intersection deviation values over the whole wave-shaped area of the recording sheet P in the head moving direction, from the intersection deviation values on the top portions Pt and the bottom portions Pb stored in the deviation storing unit 53 in S103.

More specifically, when the recording sheet P is deformed in the wave shape along the head moving direction as described above, the wave shape is expressed as shown in FIG. 8A using a position X in the head moving direction (the horizontal axis) and a height Z in the vertical direction (the vertical axis). Here, "$X_N$" represents a position of an N-th examined section Pe in the head moving direction. "$S_N$" represents a segment from "$X=X_N$" to "$X=X_{N+1}$." Further, "L," which represents a width of each segment, is expressed as "$L=X_{N+1}-X_N$" and is constant regardless of the value of "N." At this time, the height Z of the recording sheet P in the segment $S_N$ is expressed as "$Z=H_N(X)$" using "$H_N(X)$" that is a function of "X." A function, defined by the functions $H_N(X)$ with respect to all values for "N" being joined throughout all segments, is expressed as "Z=H(X)."

FIG. 8B shows a positional deviation value W of the ink landing position in the head moving direction (the vertical axis), which is expressed as "W=F(X)" as a function of the position X in the head moving direction (the horizontal axis). In the following description, "$W_0$" represents a deviation of the ink landing position in the head moving direction in the case of "$Z=Z_0$." According to an equation "(the moving distance of an ink droplet)=(the velocity of the ink droplet)×(the flying time of the ink droplet)," since the ink droplet moves in the vertical direction and the head moving direction within the same flying time, the following equation is established: "(the moving distance of the ink droplet in the vertical direction)/(the velocity of the ink droplet in the vertical direction)=(the moving distance of the ink droplet in the head moving direction)/(the velocity of the ink droplet in the head moving direction)." Namely, the equation "$(Z-Z_0)/U=(W-W_0)/V$" is established, where "V" represents the speed of the carriage 11 in the head moving direction, and "U" represents the flying velocity of the ink droplet in the vertical direction. Here, "$Z_0$," "$W_0$" "U," and "V" are constant values that do not depend on the value of "X." Therefore, the functions "Z=H(X)" and "W=F(X)" provide substantially similar wave shapes. Further, FIG. 8C shows an intersection deviation value Y of the pattern intersection in the sheet feeding direction (the vertical axis), which is expressed as "Y=G(X)" as a function of the position X in the head moving direction (the horizontal axis). As described above, since $Y=W/\tan\theta$, the function "Y=G(X)" provides a wave shape similar to the wave shapes of "Z=H(X)" and "W=F(X)."

Accordingly, as shown in FIG. 8B, the variation of the positional deviation value W of the ink landing position in the head moving direction as a function of the position X in the head moving direction is expressed as a graph that can be rendered coincident with a graph for representing the variation of the height Z of the recording sheet P by scaling and translation along the vertical axis. Likewise, as shown in FIG. 8C, the variation of the intersection deviation value Y of the pattern intersection in the sheet feeding direction as a function of the position X in the head moving direction is expressed as a graph that can be rendered coincident with a graph for representing the variation of the height Z of the recording sheet P by scaling and translation along the vertical axis. Namely, the graph of the interpolation function G(X) for the intersection deviation value Y is transformable into the graph of the interpolation function H(X) for the height Z and the graph of the interpolation function F(X) for the positional deviation value W of the ink landing position by scaling and translation along the vertical axis.

The same applies to a below-mentioned graph shown in FIG. 8D (which represents the variation of a delay time for adjusting the ink discharging timing). The four pieces of information (the four functions) shown in FIGS. 8A to 8D are substantially equivalent when the respective relevant constant values are known. Therefore, even when the deviation storing unit 53 stores any one of the four functions, or interpolation calculation is made using any one of the four functions, it is possible to correct the positional deviation value with respect to the ink landing position through appropriate transformation between the functions. In the embodiment, the following description will be provided based on an assumption that the deviation storing unit 53 stores the intersection deviation values Y.

The interpolation function G(X) is calculated for each individual one of the segments into which the patch T is partitioned by the examined sections Pe in the head moving direction. An interpolation function $G_N(X)$ represents an interpolation function for the intersection deviation values Y (the positional deviations of the pattern intersections in the sheet feeding direction) within a segment $S_N$ defined by two ends, i.e., the N-th examined section Pe and the (N+1)-th examined section Pe from the left side in the head moving direction. When the positions in the head moving direction of the N-th examined section Pe and the (N+1)-th examined section Pe from the left side in the head moving direction are "$X_N$" and "$X_{N+1}$," respectively, according to relationship with the intersection deviation values Y stored in the deviation storing unit 53 in S103, the interpolation function $G_N(X)$ needs to satisfy the following two conditional expressions.

$$G_N(X_N)=Y_N$$

$$G_N(X_{N+1})=Y_{N+1} \qquad \text{(Expressions 1)}$$

where $Y_N$ represents the intersection deviation value on the examined section Pe of the position "$X=X_N$," and $Y_{N+1}$ represents the intersection deviation value on the examined section Pe of the position "$X=X_{N+1}$."

Further, in order to continuously and smoothly connect the interpolation function $G_N(X)$ with the interpolation functions $G_{N-1}(X)$ and $G_{N+1}(X)$ of the adjacent segments $S_{N-1}$ and $S_{N+1}$, the interpolation function $G_N(X)$ needs to have first derivatives with respect to "X" that are continuous with the first derivatives with respect to "X" of the interpolation functions $G_{N-1}(X)$ and $G_{N+1}(X)$ on the corresponding bottom portion Pb and the corresponding top portion Pt, respectively. Further, at each of the both ends of each individual segment S, the interpolation function G(X) (the wave shape) has a local minimum value (a bottom) or a local maximum value (a top). Therefore, at each end of each individual segment S, the interpolation function G(X) has a first derivative equal to "0." Accordingly, the first derivative $G'_N(X)$ of the interpolation function $G_N(X)$ with respect to "X" has only to satisfy the following two conditional expressions.

$$G'_N(X_N)=0$$

$$G'_N(X_{N+1})=0 \qquad \text{(Expressions 2)}$$

The polynomial expression for the interpolation function $G_N(X)$ with respect to the coordinate X in the head moving direction of the recording sheet P is determined with the aforementioned four conditional expressions as boundary conditions. Hence, the interpolation function $G_N(X)$ is represented by the following cubic function satisfying the aforementioned four conditional expressions.

$$G_N(X) = \frac{Y_{N+1}-Y_N}{(X_{N+1}-X_N)^3}(X-X_N)^2(2X-3X_{N+1}+X_N)+Y_N \qquad \text{(Expression 3)}$$

The interpolation function $G_N(X)$ is an interpolation function for the intersection deviation value Y. In the expression 3, even though "$Y_{N+1}$," "$Y_N$," and "$G_N(X)$" are replaced with "$Y_{N+1}-Y_0$," "$Y_N-Y_0$," and "$G_N(X)-Y_0$," respectively, the equality holds with respect to any value for "$Y_0$" (regardless of the value for "$Y_0$"). Namely, the following relationship is established.

$$G_N(X) = \frac{(Y_{N+1}-Y_0)-(Y_N-Y_0)}{(X_{N+1}-X_N)^2}(X-X_N)^2(2X-3X_{N+1}+X_N)+(Y_N-Y_0)+Y_0 \qquad \text{(Expression 4)}$$

The above function (equation) may be used as a function for determining the absolute value of an intersection deviation value in an arbitrary position by substituting the absolute values of acquired intersection deviation values into the equation. Further, the above function may be used as a function for determining the deviation of an intersection deviation value in an arbitrary position from a certain value ($Y_0$) by substituting the deviations of acquired intersection deviation values from the certain value into the equation. Accordingly, intersection deviation values to be stored in the deviation storing unit 53, which are local maximum values and local minimum values of the function Y=G(X), may be represented by deviations from any value for "$Y_0$." In the embodiment, the average value of "Y" throughout all the segments is employed as "$Y_0$."

In S201, during the movement of the carriage 11, the control device 50 (the head position detecting unit 55) detects the position in the head moving direction of the inkjet head 12 reciprocating together with the carriage 11 along the head moving direction.

In S202, the control device 50 (the deviation calculating unit 56) calculates the intersection deviation value on each portion of the recording sheet P. Specifically, during the movement of the inkjet head 12 together with the carriage 11, the control device 50 (the deviation calculating unit 56) calculates, serially as needed, the intersection deviation value Y=G(X) based on the position of the inkjet head 12 (corresponding to "X" of the interpolation function $G_N(X)$) detected in S201 and the interpolation function $G_N(X)$ for the detected position.

In S203, the control device 50 (the discharging timing determining unit 57) determines the ink discharging timing to discharge ink from the nozzles 10, based on the intersection deviation values calculated in S202. Specifically, the following equation holds: $[H(X)-Z_0]:[F(X)-W_0]=U:V$. Further, when an angle between the straight lines L1 and L2 in a deviation detecting pattern Q is represented by "θ," the following equation holds: $[F(X)-W_0]:[G(X)-Y_0]=\sin\theta:\cos\theta$. When the function of a delay time D of the adjusted ink discharging timing (moment) from the design-based ink discharging timing (moment) at a coordinate value X is represented by "E(X)," based on the difference in the ink discharging timing and the positional deviation value of the ink landing position, the following equation holds: $F(X)-W_0=V\cdot(E(X)-D_0)$. From the aforementioned equations, the function E(X) is expressed as follows.

$$E(X) = \frac{\tan\theta}{V}(G(X)-Y_0)+D_0 \qquad \text{(Expression 5)}$$

FIG. 8D is a graph showing the function D=E(X), which is transformed to be coincident with the graphs shown in FIGS. 8A to 8C by scaling and translation along the vertical axis.

In S204, the control device 50 (the recording control unit 51) controls the printing unit 2 to discharge ink from the nozzles 10 in accordance with the ink discharging timing determined in S203. The control device 50 repeatedly performs the steps S201 to S204 until determining that the printing operation is completed (S205: No). When determining that the printing operation is completed (S205: Yes), the control device 50 terminates the process shown in FIG. 9. It is noted that, in the embodiment, when the inkjet head 12 reaches a predetermined position, the control device 50 receives a signal from the encoder sensor 20 and controls the inkjet head 12 to discharge ink from the nozzles 10. Therefore, it is difficult for the inkjet head 12 to discharge ink from the nozzles 10 at a moment earlier than the design-based ink discharging timing (moment). Accordingly, a value satisfying the condition "D≥0" is always selected for "$D_0$."

According to the embodiment described above, when the recording sheet P is deformed in such a wave shape that the plurality of mountain portions Pm and the plurality of valley portions Pv are alternately arranged along the head moving direction, the gap between the ink discharging surface 12*a* and the recording sheet P varies depending on portions on the recording sheet P. Further, in a situation where the gap between the ink discharging surface 12*a* and the recording sheet P varies depending on portions on the recording sheet P, and the ink is discharged from the nozzles 10 in accordance with the same ink discharging timing as when the recording sheet P is flat, there are differences between the positional deviation values caused in the rightward movement of the carriage 11 along the head moving direction and the positional deviation values caused in the leftward movement of the carriage 11 along the head moving direction. Therefore, in order to land ink droplets in appropriate positions on such a wave-shaped recording sheet P, it is required to determine the ink discharge timing to discharge the ink droplets from the nozzles 10 depending on the gap at each individual portion on the recording sheet P.

In the embodiment, by printing the deviation detecting patterns Q on the wave-shaped recording sheet P and reading the printed deviation detecting patterns Q, the intersection deviation values on the top portions Pt and the bottom portions Pb are acquired. Further, each individual intersection deviation value is stored in the deviation storing unit 53 in a form divided into the average value $Y_0$ and the deviation $(Y-Y_0)$ from the average value $Y_0$. Moreover, the interpolation function $G_N(X)$ is calculated based on the stored deviations $(Y-Y_0)$ of the intersection deviation values relative to the average value $Y_0$. Thereby, it is possible to acquire the intersection deviation value on every portion over the whole wave-shaped area of the recording sheet P in the head moving direction (over an entire area including all the examined sections Pe in the head moving direction), based on the average value $Y_0$, the deviations $(Y-Y_0)$ of the intersection deviation values relative to the average value $Y_0$, and the interpolation function $G_N(X)$.

Furthermore, by determining the ink discharging timing (to discharge ink from the nozzles 10) based on the delay time D, which is calculated from the position of the inkjet head 12 and the interpolation function $G_N(X)$, in the printing operation, it is possible to discharge ink droplets onto appropriate positions of the wave-shaped recording sheet P.

At this time, the technique according to aspects of the present invention is not configured to acquire, from the deviation detecting patterns Q, the intersection deviation value on every portion over the whole wave-shaped area of the recording sheet P in the head moving direction. The technique according to aspects of the present invention is configured to acquire only the intersection deviation values on the top portions Pt and the bottom portions Pb, calculate the interpolation function $G_N(X)$ from the acquired intersection deviation values, and then acquire the intersection deviation value on every portion over the whole wave-shaped area of the recording sheet P in the head moving direction, from the average value $Y_0$ of the intersection deviation values and the interpolation function $G_N(X)$. Thus, it is possible to lessen the number of the intersection deviation values to be stored in the deviation storing unit 53 so as to achieve a low storage capacity of the RAM of the control device 50. Further, at the same time, it is possible to acquire the intersection deviation value on every portion over the whole wave-shaped area of the recording sheet P in the head moving direction.

Further, at this time, as described above, the interpolation function $G_N(X)$ is represented by the cubic function. Here, in S102, an intersection deviation value on a portion between the top portion Pt and the bottom portion Pb of the recording sheet P may be further acquired as an intersection deviation value in an examined section. In this case, since the number of the conditional expressions increases, it is possible to determine the interpolation function $G_N(X)$ as a polynomial of the fourth or higher order.

However, in this case, since the number of the intersection deviation values to be stored in the deviation storing unit 53 rises, it is required to increase the storage capacity of the RAM of the control device 50. Further, the increased number of the conditional expressions leads to an increased number of calculations for determining the interpolation function $G_N(X)$ in S104. Moreover, the interpolation function $G_N(X)$ becomes a biquadratic function or a higher-order function, and it results in an increased number of calculations for determining the intersection deviation values in S202.

Accordingly, the cubic function is considered as an appropriate polynomial expression to be used for interpolating the intersection deviation values, since the cubic function makes it possible to lessen the number of the intersection deviation values to be acquired and determine the interpolation function $G_N(X)$ in an easy and accurate manner.

Further, the first term of the interpolation function $G_N(X)$ has the denominator $(X_{N+1}-X_N)^3$. Nonetheless, as described above, when the corrugated plates 15, the ribs 16, and the corrugated spur wheels 18 and 19 are arranged at substantially regular intervals along the head moving direction, respectively, the value of $(X_{N+1}-X_N)$ corresponding to the distance in the head moving direction between each adjacent two portions of the top portions Pt and the bottom portions Pb is constant. Thus, the value of the denominator $(X_{N+1}-X_N)^3$ is also constant. In general, a calculator needs a more time for division than for multiplication. Therefore, as the value of the denominator $(X_{N+1}-X_N)^3$ is constant, it is possible to shorten a time required for determining the interpolation function $G_N(X)$, by previously calculating the value of "$1/(X_{N+1}-X_N)^3$" and multiplying the previously calculated constant value "$1/(X_{N+1}-X_N)^3$" instead of dividing by $(X_{N+1}-X_N)^3$, so as to determine the deviation D.

Further, in the embodiment, in S202, during the movement of the carriage 11 in the printing operation, the control device 50 acquires the position of the inkjet head 12, acquires the average value $Y_0$ and the deviation $(Y-Y_0)$ of the intersection deviation value relative to the average value $Y_0$ based on the acquired position of the inkjet head 12 and the interpolation function $G_N(X)$ corresponding to the acquired position. Further, the control device 50 calculates, serially as needed, the intersection deviation value from the acquired average value $Y_0$ and the acquired deviation $(Y-Y_0)$, and determines, serially as needed, the ink discharging timing (to discharge ink from the nozzles 10) based on the calculated intersection deviation value.

Accordingly, it is not required to previously calculate the intersection deviation values over the whole wave-shaped area of the recording sheet P or store the calculated intersection deviation values in the RAM of the control device 50 in advance of the printing operation. Hence, it is possible to reduce the storage capacity of the RAM of the control device 50. Further, in the case where the intersection deviation values over the whole wave-shaped area of the recording sheet P are stored in the RAM of the control device 50, when intersection deviation values in a partial area are changed, for instance, by positional adjustment of corrugated plates 15 after the storing of the intersection deviation values, the intersection deviation values corresponding to the partial area stored in the RAM have to be individually updated. On the contrary, in the embodiment, the intersection deviation values are calculated serially as needed. Thus, in such a case, it is possible to easily update the intersection deviation values, stored in the deviation storing unit 53, corresponding to the top portions Pt and the bottom portions Pb within the partial area. Further, only by calculating the interpolation function $G_N(X)$ based on the updated intersection deviation values, it is possible to easily change the intersection deviation values over the entire partial area to corrected intersection deviation values.

Further, in the embodiment, in S103, the deviation storing unit 53 is caused to store the intersection deviation value Y corresponding to each examined section Pe in a form divided into the average value $Y_0$ and the deviation $(Y-Y_0)$ from the average value $Y_0$. Based on the stored intersection deviation values, in S104, the control device 50 (the interpolation function determining unit 54) determines the interpolation function $G_N(X)$ for interpolating the intersection deviation values Y over the whole wave-shaped area of the recording sheet P in the head moving direction. Therefore, when the amplitude of the wave shape (the height difference between the top portions Pt and the bottom portions Pb) is changed by adjustment after the storing of the intersection deviation values into the deviation storing unit 53, it is possible to individually adjust the deviations $(Y-Y_0)$. Further, when the height of the recording sheet P as a whole or the moving speed of the carriage 11 is changed, it is possible to adjust the average value $Y_0$. Thus, it is possible to separately adjust the average value $Y_0$ and the deviations $(Y-Y_0)$.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, the deviation storing unit 53 is caused to store the intersection deviation value Y corresponding to each examined section Pe in a form divided into the average value $Y_0$ and the deviation $(Y-Y_0)$ from the average value $Y_0$. However, the deviation storing unit 53 may be caused to store the intersection deviation value Y (e.g., the value of $Y_N$ in FIG. 8C) corresponding to each examined section Pe as it is (without being divided into the average value and the deviation).

Further, the deviation storing unit 53 may be caused to store the positional deviation value W in the main scanning direction (the head moving direction) of the ink landing position in each examined section Pe, the delay time D of the ink discharging timing to be applied to each examined section Pe, or a value resulting from adding a constant value to the delay time D or subtracting the constant value from the delay time D.

In the aforementioned embodiment, in S203, the control device 50 (the discharging timing determining unit 57) calculates, serially as needed, the intersection deviation value on a portion of the recording sheet P corresponding to the detected position of the inkjet head 12 which is moving in the printing operation, and determines the ink discharging timing based on the calculated intersection deviation value. However, for instance, the control device 50 may previously calculate the intersection deviation values over the whole wave-shaped area of the recording sheet P based on the interpolation function $G_N(X)$ in advance of the printing operation, and may store all the calculated intersection deviation values into the RAM of the control device 50. Further, the control device 50 may determine the ink discharging timing based on the stored intersection deviation values when performing the printing operation.

In the aforementioned embodiment, the plurality of corrugated plates 15, the plurality of ribs 16, and the plurality of corrugated spur wheels 18 and 19 are arranged at substantially regular intervals along the head moving direction, respectively. However, they do not necessarily have to be arranged at regular intervals along the head moving direction.

In the aforementioned embodiment, the interpolation function $G_N(X)$ is represented by the cubic function. However, as described above, the interpolation function $G_N(X)$ may be represented by a polynomial expressed as a biquadratic function or a higher-order function. Alternatively, in the position where the interpolation function $G_N(X)$ in the segment $S_N$ is connected with the interpolation function $G_{N+1}(X)$ in the adjacent segment $S_{N+1}$, the change rate of the functions with respect to the coordinate X may separately be determined, and the interpolation function G(X) may be determined as third-order pluralistic simultaneous equations with the determined change rate as a boundary condition. Further, when the interpolation function $G_N(X)$ is not required to smoothly connect with the interpolation functions $G_{N-1}(X)$ and $G_{N+1}(X)$ of the adjacent segments $S_{N-1}$ and $S_{N+1}$, the interpolation function $G_N(X)$ may be determined as a polynomial of the second or lower order. Or the interpolation function $G_N(X)$ may be determined as a function such as a sine function other than the polynomial.

In the aforementioned embodiment, the intersection deviation values on the top portions Pt and the bottom portions Pb are acquired by reading the printed deviation detecting patterns Q using the image scanner 61 provided separately from the inkjet printer 1, e.g., at a stage of manufacturing the inkjet printer 1. However, as shown in FIG. 10, the control device 50 may further include a deviation acquiring unit 58. In this case, the reading control unit 52 may control the reading unit 5 to read the deviation detecting patterns Q, and the deviation acquiring unit 58 may acquire the intersection deviation values on the top portions Pt and the bottom portions Pb based on the read deviation detecting patterns Q. Thereafter, the deviation storing unit 53 may be caused to store the acquired intersection deviation values.

Further, in the modification, the inkjet printer 1 needs to have the reading unit 5 to read the deviation detecting patterns Q. Meanwhile, in the aforementioned embodiment, the image scanner 61 provided separately from the inkjet printer 1 reads the deviation detecting patterns Q. Therefore, the inkjet printer 1 may be configured to perform only printing, without the reading unit 5.

In the aforementioned embodiment, the control device 50 controls the printing unit 2 to print the deviation detecting patterns Q each of which has the straight lines L1 and L2 intersecting each other, by discharging ink from the nozzles 10 while moving the carriage 11 toward one side along the head moving direction to print the straight line L1 and by discharging ink from the nozzles 10 while moving the carriage 11 toward the other side along the head moving direction to print the straight line L2.

However, for instance, deviation detecting patterns may be printed in the following method. The method may include printing a plurality of straight lines L2 on a recording sheet P, on which a plurality of lines similar to the straight lines L1 are previously printed, by discharging ink from the nozzles 10 while moving the carriage 11 toward the one side or the other side along the head moving direction, so as to form deviation detecting patterns each of which has a previously printed straight line and a later printed straight line L2 intersecting each other. Even in this case, by reading the formed deviation detecting patterns, it is possible to acquire a positional deviation value, relative to a predetermined reference position, of an ink droplet landing on each portion of the top portions Pt and bottom portions Pb.

Further, the deviation detecting pattern is not limited to a pattern with two straight lines intersecting each other. The deviation detecting pattern may be another pattern configured to produce a printed result varying depending on the positional deviation value with respect to the ink landing position.

In the aforementioned embodiment, the intersection deviation values are determined over the whole wave-shaped area of the recording sheet P in the head moving direction by calculating the interpolation function $G_N(X)$ in every segment S. However, for instance, when the wave-shaped recording sheet P includes a billowing area of top portions Pt and bottom portions Pb and a less billowing area of top portions Pt and bottom portions Pb, the intersection deviation values and the ink discharging timing may be determined based on the interpolation function $G_N(X)$ calculated only for segments S corresponding to the top portions Pt and the bottom portions Pb within the billowing area of the recording sheet P.

Regarding segments S for which the interpolation function $G_N(X)$ is not calculated, the top portions Pt and the bottom portions Pb corresponding to the segments S are within the less billowing area. Therefore, the positional deviation values of ink droplets landing on the top portions Pt and the bottom portions Pb within the less billowing area are considered as having less influence on the quality of the printed image. Thus, for the segments S within the less billowing area, the ink discharging timing may be determined to be the same as when the recording sheet P is not deformed in the wave shape.

In the aforementioned embodiment, by printing the deviation detecting patterns Q and reading the printed deviation detecting patterns Q, the intersection deviation values in the top portions Pt and the bottom portions Pb are acquired as gap information related to a gap between the ink discharging surface 12*a* and each portion on the recording sheet P. However, different information may be acquired that is related to the gap between the ink discharging surface 12*a* and each portion on the recording sheet P. Further, the gap between the ink discharging surface 12*a* and each individual portion of the top portions Pt and the bottom portions Pb may be acquired by direct measurement of the gap.

What is claimed is:

1. An inkjet printer comprising:

an inkjet head configured to discharge ink droplets from nozzles formed in an ink discharging surface thereof;

a head moving unit configured to reciprocate the inkjet head relative to a recording sheet along a head moving direction parallel to the ink discharging surface;

a storing device configured to store gap information comprising:

first gap information related to a first gap between the ink discharging surface and a first portion of the recording sheet, in a direction perpendicular to the ink discharging surface, the first portion being positioned in a first position on the recording sheet; and second gap information related to a second gap between the ink discharging surface and a second portion of the recording sheet in the direction perpendicular to the ink discharging surface, the second portion being positioned in a second position on the recording sheet, the first position and the second position spaced apart from each other in the head moving direction; and a control device configured to calculate interpolation gap information related to an interpolation gap between the ink discharging surface and a third portion of the recording sheet based on the first gap information and the second gap information stored in the storing device, the third portion being positioned in a third position between the first position and the second portion in the head moving direction on the recording sheet.

2. The inkjet printer according to claim 1, wherein the control device is configured to calculate the interpolation gap information to be interpolated over a segment between the first portion and the second portion on the recording sheet in the head moving direction.

3. The inkjet printer according to claim 1, further comprising a pattern printing control device configured to control the inkjet head and the head moving unit to print, in examined sections on the recording sheet, the examined sections being discretely arranged along the head moving direction on the recording sheet, each of the examined sections including a corresponding one portion of the first portion and the second portion on the recording sheet, deviation detecting patterns for detecting positional deviation values in the head moving direction between first ink landing positions of ink droplets discharged from the nozzles during movement of the inkjet head toward a first side along the head moving direction and second ink landing positions of ink droplets discharged from the nozzles during movement of the inkjet head toward a second side opposite to the first side along the head moving direction, and wherein the storing device is configured to:

communicably connect with a deviation acquiring device comprising a reading unit, the deviation acquiring device configured to acquire the positional deviation values respectively corresponding to the examined sections, by controlling the reading unit to read the deviation detecting patterns printed on the recording sheet;

receive, from the deviation acquiring device, the acquired positional deviation values respectively corresponding to the examined sections; and store the received positional deviation values as the gap information.

4. The inkjet printer according to claim 1, wherein the first gap and the second gap are different in length from each other.

5. The inkjet printer according to claim 4, wherein the first portion is a top portion of a portion protruding in a first direction toward the ink discharging surface, and wherein the second portion is a bottom portion of a portion recessed in a second direction opposite to the first direction.

6. The inkjet printer according to claim 5, wherein the control device is configured to calculate the interpolation gap information to be interpolated over a segment between the top portion and the bottom portion, using a cubic curve that has a local maximum value and a local minimum value corresponding to the top portion and the bottom portion, respectively, based on the first gap information and the second gap information stored in the storing device.

7. The inkjet printer according to claim 5, further comprising a recording sheet deforming unit configured to deform the recording sheet in a predetermined shape that has the top portion and the bottom portion.

8. The inkjet printer according to claim 1, further comprising a discharging timing determining device configured to determine ink discharging timing with which the inkjet head is to discharge ink droplets from the nozzles while moving along the head moving direction, based on the interpolation gap information calculated by the control device.

9. The inkjet printer according to claim 8, further comprising a position detecting device configured to detect a position of the inkjet head in the head moving direction, wherein the control device is configured to calculate the interpolation gap information in the position detected by the position detecting device, and wherein the discharging timing determining device is configured to determine the ink discharging timing based on the interpolation gap information calculated by the control device for the position of the inkjet head in the head moving direction.

10. A method implemented on a control device coupled with an inkjet printer, the inkjet printer comprising: an inkjet head configured to discharge ink droplets from nozzles formed in an ink discharging surface thereof; and a head moving unit configured to reciprocate the inkjet head relative to a recording sheet along a head moving direction parallel to the ink discharging surface, the method comprising:

storing first gap information related to a first gap between the ink discharging surface and a first portion of the recording sheet, in a direction perpendicular to the ink discharging surface, the first portion being positioned in a first position on the recording sheet;

storing second gap information related to a second gap between the ink discharging surface and a second portion of the recording sheet, in the direction perpendicular to the ink discharging surface, the second portion being positioned in a second position on the recording sheet, the first position and the second position spaced apart from each other in the head moving direction; and calculating interpolation gap information related to an interpolation gap between the ink discharging surface and a third portion of the recording sheet based on the stored first gap information and the stored second gap information, the third portion being positioned in a third position between the first portion and the second portion in the head moving direction on the recording sheet.

* * * * *